United States Patent [19]

Young, Jr.

[11] Patent Number: 4,815,405

[45] Date of Patent: Mar. 28, 1989

[54] APPARATUS FOR SPLICING INDETERMINATE LENGTHS OF FABRIC

[75] Inventor: William O. Young, Jr., Spartanburg, S.C.

[73] Assignee: Young Engineering, Inc., Spartanburg, S.C.

[21] Appl. No.: 107,390

[22] Filed: Oct. 13, 1987

[51] Int. Cl.[4] ..... D05B 3/00; D05B 21/00; D05B 27/00

[52] U.S. Cl. ..... 112/121.14; 112/121.12; 112/307; 242/58.1; 242/58.4

[58] Field of Search ..... 112/121.14, 121.11, 112/121.12, 121.15, 121.29, 113, 10, 307, 303; 242/58.1, 58.4

[56] References Cited

U.S. PATENT DOCUMENTS

| | | | |
|---|---|---|---|
| 4,457,243 | 7/1984 | Bowditch | 112/121.14 |
| 4,624,198 | 11/1986 | Beam et al. | 112/10 |
| 4,700,642 | 10/1987 | Hankinson, Jr. | 112/121.14 |

*Primary Examiner*—H. Hampton Hunter
*Attorney, Agent, or Firm*—Dority & Manning

[57] ABSTRACT

Apparatus and method for supplying a secondary fabric to a fabric processing machine. The movement of the primary fabric to the fabric processing machine is interrupted and the primary fabric is clamped at spaced points. The primary fabric is severed at a point between the clamping points and the tail end of the primary fabric is aligned with the head end of the secondary fabric and the two are sewn together by a sewing machine which traverses the widths of the fabrics. The head end of the primary fabric is moved to a holding position. The clamp for the head end of the secondary fabric and the clamp for the tail end of the primary fabric are released and the feeding means for feeding the fabric is restarted to feed the secondary fabric to the fabric processing machine. After the desired amount of secondary fabric is processed by said fabric processing machine, its feeding to the fabric processing machine is interrupted, the secondary fabric is clamped at spaced points, and is severed at a point between the spaced clamping points. The tail end of the secondary fabric is then aligned with the head end of the primary fabric and the two are sewn together at a sewing station. The clamp for the head end of the primary fabric and the clamp for the tail end of the secondary fabric are then returned to their run positions and the clamp is released and the feeding means is restarted to move said primary fabric to said fabric processing machine. The method may be carried out manually by using the apparatus, or automatically by the automated apparatus. A fabric splicing system is also disclosed and claimed.

21 Claims, 7 Drawing Sheets

APPARATUS FOR SPLICING INDETERMINATE LENGTHS OF FABRIC

BACKGROUND OF THE INVENTION

The present invention relates to a method and apparatus for splicing a new end of fabric onto the tail end of a fabric already threaded into a fabric processing machine.

Where fabric is being processed in indeterminate lengths such as by printing or dyeing in the open width, it sometimes becomes necessary, either to change the process or to change the fabric being processed, without stopping the machine for an extended length of time. Also, it is important when making machine changes such as color, print design and the like to avoid loss of fabric yardages during the changeover. When this becomes necessary, it is important that the primary fabric which is being printed or processed on the finishing machine be temporarily discontinued and that a substitute or secondary fabric be processed on the machine. This secondary fabric can be a conventional leader fabric which may be used over and over to lead the primary fabric through the thread-up on the fabric processing machine or it can be a different fabric than the primary fabric which must be processed before the primary fabric is completely processed. It is highly desirable to make the transition as quickly as possible so as to avoid unnecessary down time of the machine and to avoid wastage of the primary fabric.

The present invention provides a solution to the above noted problem. Particularly, apparatus and method are provided for the quick and efficient interruption of primary fabric flow through a processing machine; introduction of a secondary fabric to the processing machine; interruption of secondary fabric flow and reintroduciton of primary fabric flow. Such enables machine and process changes without loss of primary fabric as well as provision for short runs without excess machine downtime.

There is no known prior art that anticipates or suggests the apparatus or method of the present invention.

SUMMARY OF THE INVENTION

It is an object of the present invention to provide an improved apparatus for splicing a web.

Another object of the present invention is to provide an improved method of splicing a web.

Still another object of the present invention is to provide an improved apparatus for splicing a fabric web.

Still further, another object of the present invention is to provide an improved method for splicing a fabric web.

It is yet another object of the present invention to provide a method for splicing a secondary fabric onto the tail end of a primary fabric on a processing machine.

Yet another object of the present invention is to provide automated apparatus for splicing secondary fabric onto the tail end of a primary fabric for threading the secondary fabric through a fabric processing machine.

Generally speaking, the apparatus of the present invention comprises a web joining station located adjacent a path of web travel; first and second web clamping means spaced apart along said path of web travel, said clamping means being operative to permit web travel therethrough during normal web travel and to clamp said web when web splicing is desired; said first clamping means being movable to and from said web joining station, and said second clamping means being movable between said web path and said web joining station; web severing means located adjacent said web path of travel between said first and second clamping means and being movable between an inactive position and a web severing position for severing said web when it is clamped by said first and second clamping means; third web clamping means located adjacent said path of web travel for receipt of a secondary web and being movable between said web joining station and said path of web travel; and means located at said web joining station for joining web ends held by two of said web clamps located thereat.

The present invention thus provides a process whereby a primary fabric being fed to a fabric processing machine may be interrupted in its movement and clamped at spaced locations along its path of travel. The primary fabric is then severed between the spaced clamped points and the clamped tail end of the primary fabric is moved to a joining station, preferably a sewing station where it is aligned with a head end of a secondary fabric, which preferably is also held by a clamp. The tail end of the primary fabric and the head end of the secondary fabric are then joined preferably by a sewing machine which traverses the width of the fabrics, and at the same time trims excess fabric from the seam formed between the two. After the head end of the secondary fabric is sewn to the tail end of the primary fabric, the clamping means holding the tail end of the primary fabric is moved back into its position along the path of fabric travel as is the clamping means which holds the head end of the secondary fabric. The respective clamping means are then opened to permit the secondary fabric to be drawn through both of the clamping means into the fabric processing machine. At the same time, the head end of the primary fabric remains held in its clamp in a position out of the run line of the secondary fabric.

After the fabric processing machine is adjusted and has reached equilibrium conditions, or the short run of the secondary fabric is completed, the movement of the secondary fabric through the fabric processing machine is interrupted and the tail clamp and the secondary fabric head end clamp are closed to grip the secondary fabric at spaced points along its path of travel. The severing means then traverses the width of the fabric, cutting the fabric at a point in between the two clamping means. The clamp holding the head end of the secondary fabric is then moved to its rest position, and the clamp holding the tail end of the secondary fabric and the clamp holding the head end of the primary fabric, are each moved to the joining position, at which point the sewing machine or other joining means, joins the head end of the primary fabric onto the tail end of the secondary fabric. The clamping means for the tail end of the secondary fabric and for the head end of the primary fabric are then returned to the run positions and are opened so as to permit the primary fabric to again be drawn through the fabric processing machine without interference from the clamping means.

In a preferred arrangement, the clamping means for the head end of a secondary fabric, the head end of the primary fabric, and for the tail end of the fabric being processed, are supported mechanically on arms which swing within each other about pivots so as to bring the various clamps to and from the appropriate positions without interference to perform the intended operations as described above. In this preferred embodiment, the various clamps are pivotally mounted on their individual swing arms and are indexed to present the ends of the fabrics clamped therebetween in proper alignment at the sewing station at which point they may be correctly aligned to be sewn together by a sewing machine which traverses the width of the fabrics.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DETAILED DESCRIPTION OF THE DRAWINGS

Figure 1:
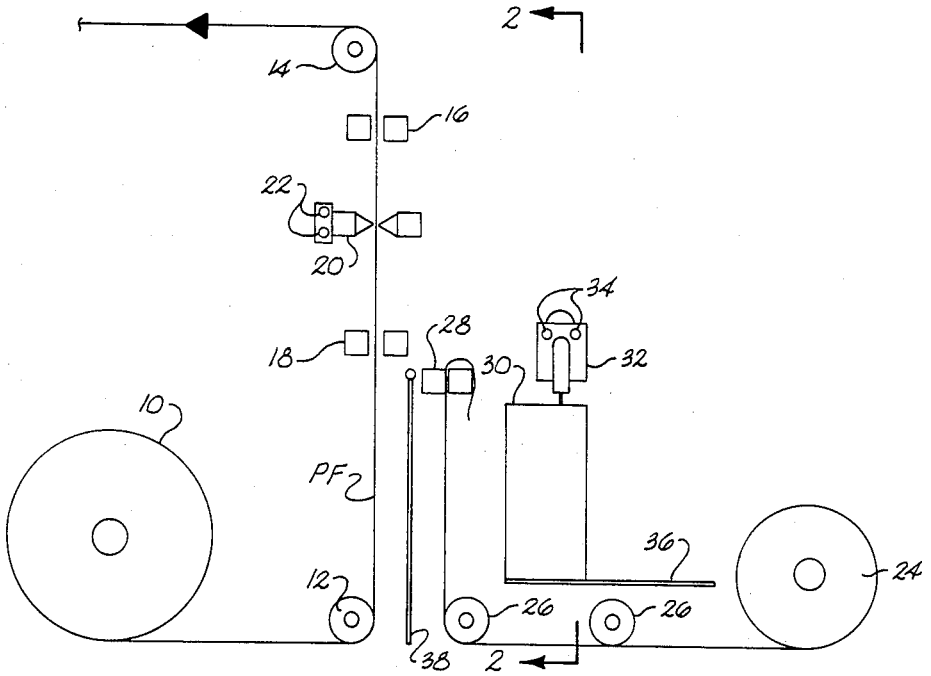
FIG. 1 is a schematic side elevation view of apparatus according to the present invention.
Figure 2:
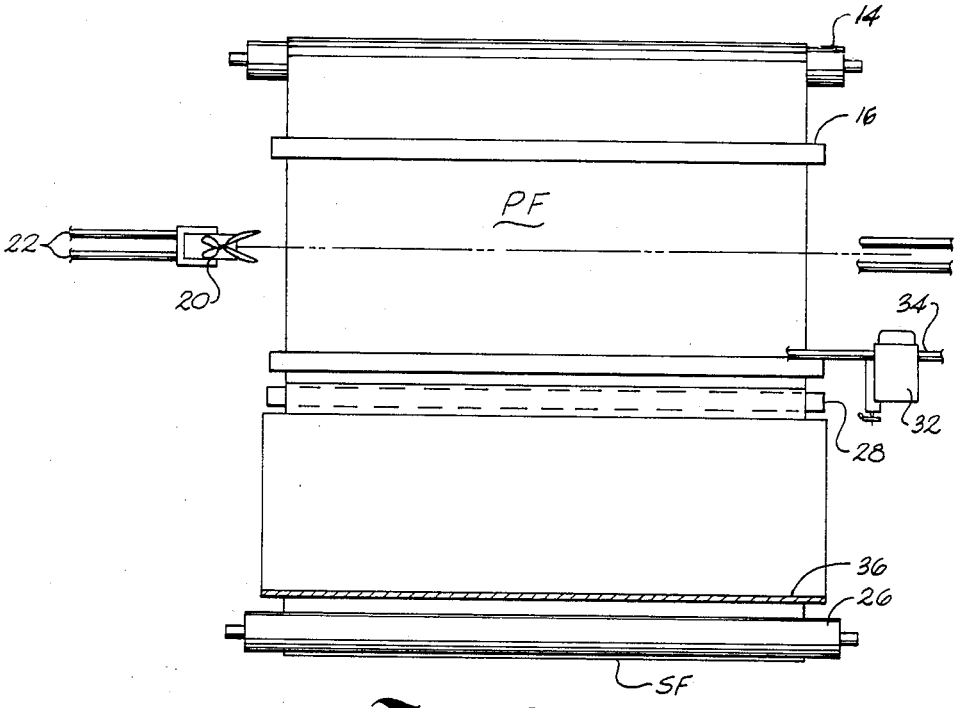
FIG. 2 is a front view of the apparatus of Figure 1, taken along line 2—2 of FIG. 1.

Referring now to FIGS. 1 and 2 of the drawings, a fabric supply 10 supplies a primary fabric PF, which is guided about guide roll 12 and feed roll 14 along a fabric path to a fabric processing machine (not shown) wherein the fabric may be subjected to various processing steps or operations such as printing, singeing, dyeing or the like. Disposed adjacent the path along which fabric PF moves is a tail end or first clamping means 16 having clamping surfaces on opposite sides of the fabric path, and a head end or second clamping means 18 also having clamping surfaces disposed on opposite sides of the primary fabric path, as seen in FIG. 1. First and second clamping means 16 and 18 are spaced apart along the fabric path. Disposed at a point intermediate clamping means 16 and 18 is a cutting means 20 supported by two traverse rods 22. Cutting means 20 is adapted to sever the fabric at a point intermediate clamping means 16 and 18.

A secondary fabric supply 24 supplies a secondary fabric SF about guide roll 26 to a secondary fabric head end or third clamping means 28 wherein it remains at rest and clamped while primary fabric PF is being processed on the fabric processing machine. Between the primary fabric PF and the secondary fabric SF is a fabric separator 38 which maintains a separation between the parallel paths of said primary fabric PF and said secondary fabric SF.

Adjacent to the fabric clamping means 16, 18 and 28 is a support surface 30 which is adapted to receive and support the clamping means located thereat while a sewing head 32 traverses the width of the fabrics for sewing the tail end of the primary fabric to the head end of the secondary fabric, when desired. A platform 36 is provided for the worker to stand upon when carrying out the process if manual operations are desired. Sewing head 32 may have either a horizontally operating needle or a vertically operating needle, and preferably is a conventional sewing head that both sews the desired stitch and trims excess fabric outside of the stitch.

Steps of the process of the present invention may be carried out using the apparatus illustrated in FIGS. 1 and 2 according to the arrangements as seen in FIGS. 3–10.

Figure 3:
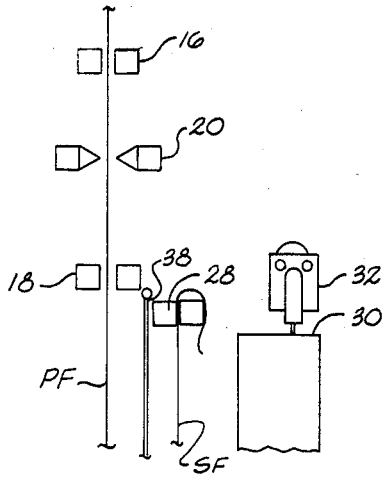
FIGS. 3–10 illustrate schematically the steps of a method according to the present invention and apparatus for carrying out the various steps of the method.
Figure 4:
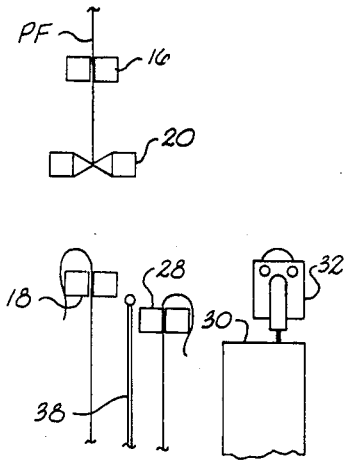

Referring now to FIGS. 3–10, it will be seen that in FIG. 3 the primary fabric continues to move between the clamping surfaces of clamping means 16 and 18 and on to the fabric processing machine. When it is decided to change the process of the processing machine or to process a different or secondary fabric instead of the primary fabric, movement of fabric PF is interrupted and clamps 16 and 18 are closed to grip the primary fabric. After the fabric movement is stopped and the fabric is clamped, and it is severed at a point intermediate the clamping means 16 and 18, by cutting means 20 as seen in FIG. 4.

Figure 5:
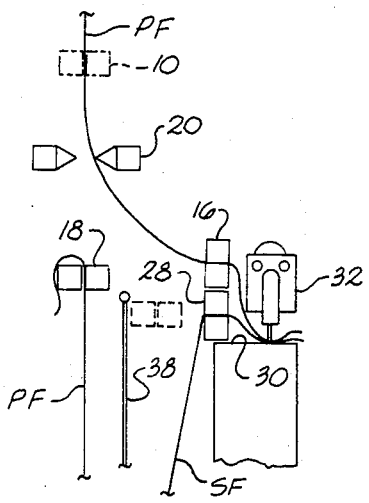

Once primary fabric PF is clamped and severed, an operator may grasp clamp 28 and move clamp 28 along with a head end of secondary fabric SF to support surface 30 where clamp 28 is located for subsequent sewing. Clamp 16 and the tail end of primary fabric PF may then be moved to support 30 and located atop clamp 28. The tail end of the primary fabric is then aligned with the head end of the secondary fabric as seen in FIG. 5. Sewing head 32 may then traverse the width of the two fabrics, either automatically or manually, to sew the head end of the secondary fabric to the tail end of the primary fabric, while at the same time trimming any excess fabric from the seam.

Figure 6:
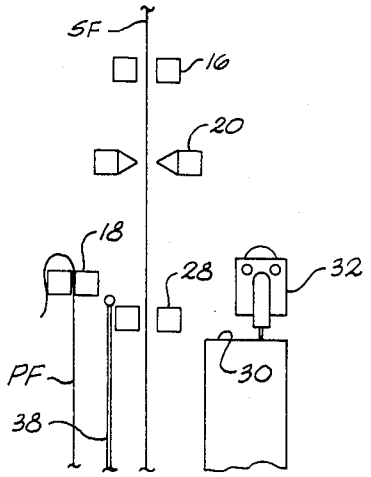

After the ends of the fabrics are sewn together, clamping means 16 may be returned to its run position as seen in FIG. 6 and clamping means 28 is returned to its former rest position, and the clamps are opened to permit the secondary fabric to be drawn between the clamps and through the fabric processing machine for as long a period as is desired, depending on the reasons for substituting the secondary fabric for the primary fabric.

Figure 7:
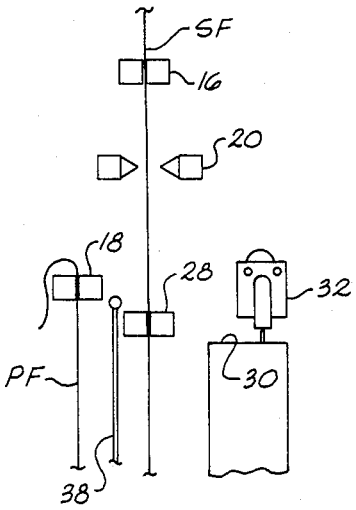
Figure 8:
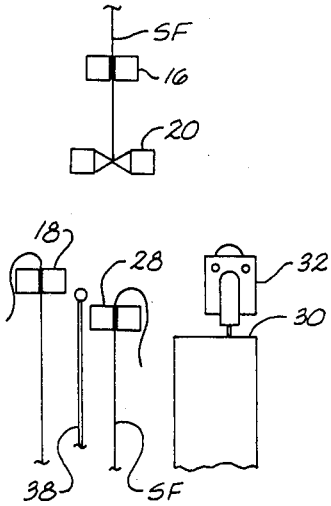
Figure 9:
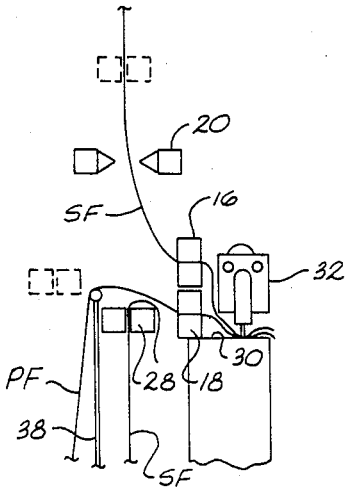

After the operation of modifying the process or processing apparatus, or the short run of the secondary fabric is completed, the movement of the secondary fabric through the processing machine is interrupted and clamps 16 and 28 are closed to grip the secondary fabric at spaced points as seen in FIG. 7. Cutter 20 then severs secondary fabric SF at a point between the clamps 16 and 28 as seen in FIG. 8. Clamp 18 with the head end of primary fabric PF and clamp 16 with the tail end of secondary fabric SF may be brought to and support 30 as seen in FIG. 9 after which sewing head 32 traverses the width of the two fabrics to sew the head end of the primary fabric onto the tail end of the secondary fabric and, at the same time, trimming the excess material from the seam, as seen in FIG. 9.

Figure 10:
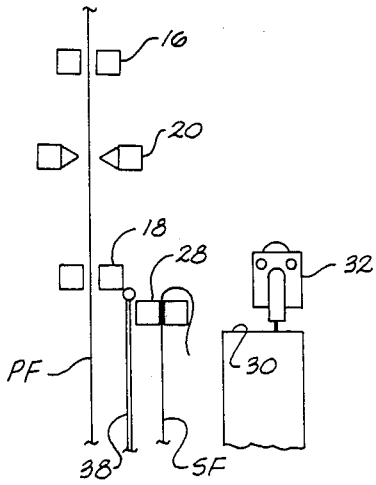

After the fabrics are sewn together, clamping means 16 is returned again to its run position and clamping means 18 is returned to its running position, and the two clamping means are opened to permit the primary fabric to be drawn between the clamping surfaces of clamps 16 and 18 as seen in FIG. 10. At the same time, the head end of the secondary fabric SF is held by clamping means 28 in a rest position. Movement of the fabric is restarted and processing of the primary fabric is resumed.

The above steps of splicing a fabric may be performed partially manually or automatically, depending upon the state of the apparatus. For example, presently there is no means available for an operator to handle a fabric that may be 100 inches wide while maintaining all portions of the fabric across its width appropriately for joining same to an end of another portion of fabric. Instead, the operator must first pull the fabric to the sewing location and then align the end of same with an aligned end of the other fabric. Manual alignment of both of the fabrics is painstaking and inefficient, and even then difficulty is encountered in achieving proper alignment for production of a proper splicing.

When, however, a fabric is moving along its path, being maintained in a proper manner, stoppage of fabric movement leaves a properly positioned fabric. Once the clamping means is closed, the fabric is held in a proper attitude and an operator can then simply grasp the clamp and move it and the fabric to the appropriate location for sewing. Once the clamp is properly located, so is the fabric. Hence, use of the present invention affords a quick and easy means for fabric splicing with the resultant seam being quite proper and correct.

Similarly, the apparatus of the present invention may be fully automated as described hereinafter, requiring only operator actuation of the system.

Figure 11:
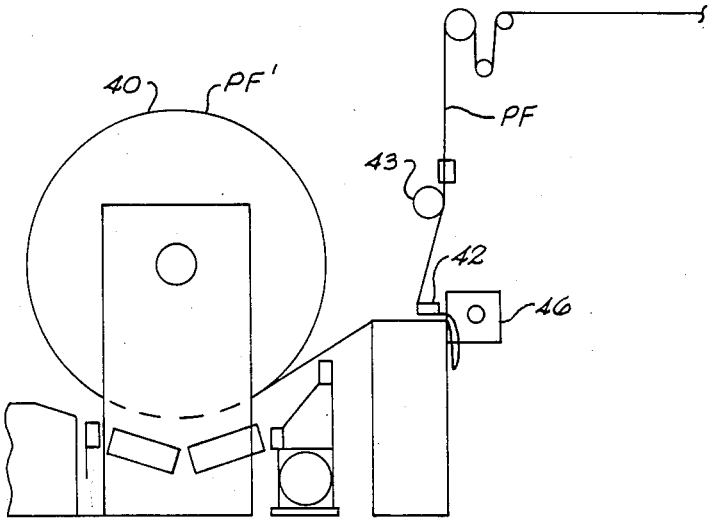
FIGS. 11 and 12 illustrate diagrammatically, in a side elevation, the steps of splicing a replacement roll of the primary fabric onto the tail end of a previously exhausted roll of primary fabric, and the apparatus for carrying out the method.
Figure 12:
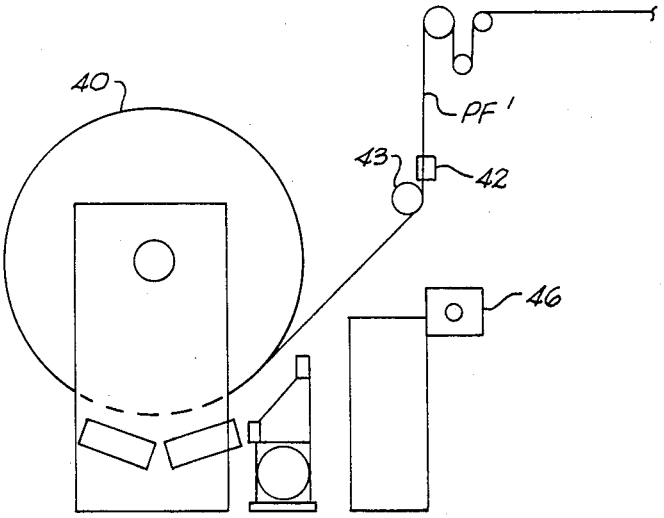

Referring now to FIGS. 11 and 12 there is illustrated apparatus for replenishing a supply of primary fabric with a new roll of the primary fabric for transport to a fabric processing machine. Again, both manual and automatic operation is possible with improved results as discussed above. In the embodiment of FIGS. 11 and 12, the primary fabric supply has been exhausted and the tail end of the primary fabric is retained by clamping means 42 and the empty beam has been replaced by a full beam 40. The leading end of the full beam 40 fabric PF′ is manually brought by the operator across the support surface 44 and appropriately positioned for sewing. Clamping means 42 is then placed atop the head end of the fabric PF′, at which point a sewing machine or head 46 may be traversed across the width of the overlying fabrics and excess material trimmed after the seam is formed thereby.

As seen in FIG. 12, after the seam is completed, clamp 42 is returned to its rest position and the clamp is open to permit the new fabric PF′ to be drawn about a guide roll 43, between the clamping surfaces of clamp 42 and to a feed roll 48 for transport to the fabric processing machine.

Figure 13:
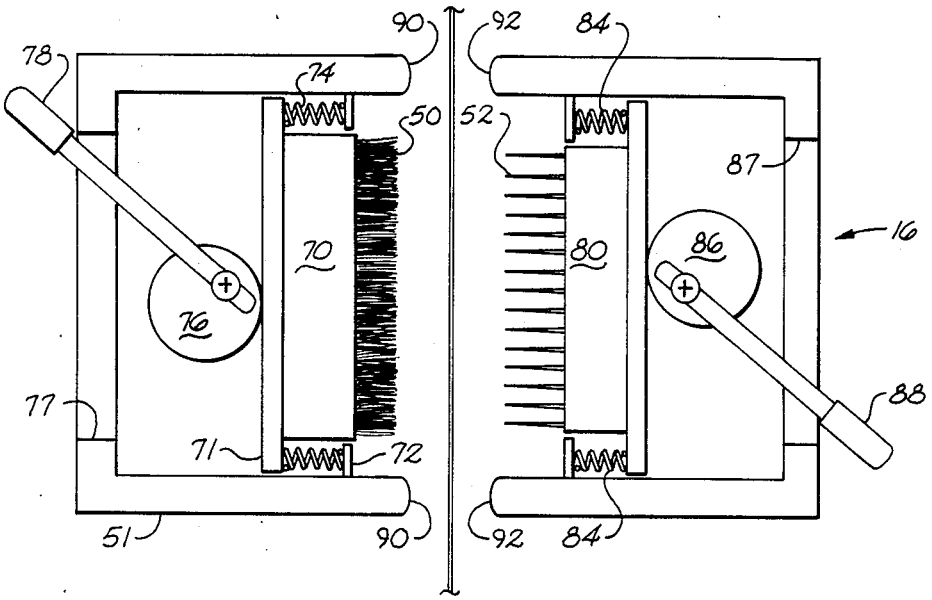
FIG. 13 is a cross-sectional view of an embodiment of a clamp according to the present invention.

Referring now to FIG. 13 there is illustrated a clamping means embodiment according to the present invention which could serve as clamping means 16, 18, 28 and 42 mentioned above. In this embodiment, the clamping means includes a clamping surface 50 having a series of brush bristles on its surface which is disposed on one side of the fabric PF. Brush 50 is supported in a housing 51 and is adapted to be moved into and out of engagement with the surface of fabric PF. On the opposite side of fabric PF is a second clamping surface 52 which includes of a plurality of pins adapted to engage and to penetrate fabric PF to firmly grip and hold same. Pin surface 52 is supported in a clamp housing 53 which is adapted to move towards and away from housing 51 to bring both surfaces 50 and 52 into contact with fabric PF.

As can be seen in FIG. 13, brush surface 50 is supported by a base 70 which is mounted within housing 51 for reciprocating movement therein. Brush support base 70 is retained within housing 51 by retainer means 72 and is urged towards the bottom of housing 71 by means of springs 74 acting against arms 71 of support 70. Springs 74 thus bias support 70 into contact with toggle cam 76 which is mounted within housing 51 for pivotal movement therein. Cam 76 may extend the full length of the housing 51 or preferably can be located at spaced locations throughout the length of the housing 51, so as to urge brush base support 70 against springs 74 whenever toggle cam arm 78 which extends from housing 51 through slot 77 is rotated in a counter-clockwise direction about the pivot of cam 76. When toggle arm 78 pivots cam 76 into the toggle or locking position, surface 50 will be brought into contact with one surface of fabric PF.

On the opposite side of fabric PF, the pin surface 52 is supported by a support base 80 which is mounted similar to that of 70 on the brush housing bar. Retaining means 82 retains the base support 80 and the pin surface 52 within housing 53 while spring means 84 act on support extensions 81 and urge pin surface 52 towards the bottom of housing 53 and against a toggle cam 86. Toggle cam 86 is provided with a toggle cam arm 88 which extends through a slot 87 in housing 53 and is adapted to rotate clockwise, as seen in FIG. 13, to move pin surface 52 into penetrating contact with fabric PF to clamp said fabric against the bristle surface 50. Housings 51 and 53 may be suitably anchored together by means not shown, so as to firmly lock or clamp the fabric whenever toggle levers 78 and 88 are moved into the locking position.

Whenever the clamping surfaces are released, the fabric PF runs freely between noses 90 and 92 of the housings 51 and 53 and is kept from contact with the surfaces of pins 52 or the surface of brush 50, even if the fabric PF flutters somewhat during its passage between the clamping surfaces.

While the type of clamp of FIG. 13 is generally preferred as a clamping means of the invention, it is to be readily understood, however, that any clamping means which will firmly and securely grip the fabric across the width of its surface may be used in the invention.

Further, since wide fabrics may be normally handled by the apparatus of the present invention, consideration may be made as to clamping the fabric across its full width. Such may generally depend upon the type of fabric being processed. For example, a generally stable woven fabric may only require sporadic clamping across its width while a flimsy knit may require continuous clamping. Hence, the brush pin arrangement of FIG. 13 may extend fully along the length of the clamp, across the full width of the fabric, or a plurality of such elements may be located along the length of the clamp means.

Manual actuation of the clamping means is illustrated in FIG. 13. The clamps could, however, be automatic such as by solenoids located in the housings behind the brush and pin units which would move the brush and- /or pin units into and out of clamping engagement. Likewise, solenoids or other means could be employed to move clamp housings 51, 53 if desired. Also, while according to the embodiment of FIG. 13, both of the brush and pin surfaces are movable, obviously one could be movable relative to the other.

Figure 15:
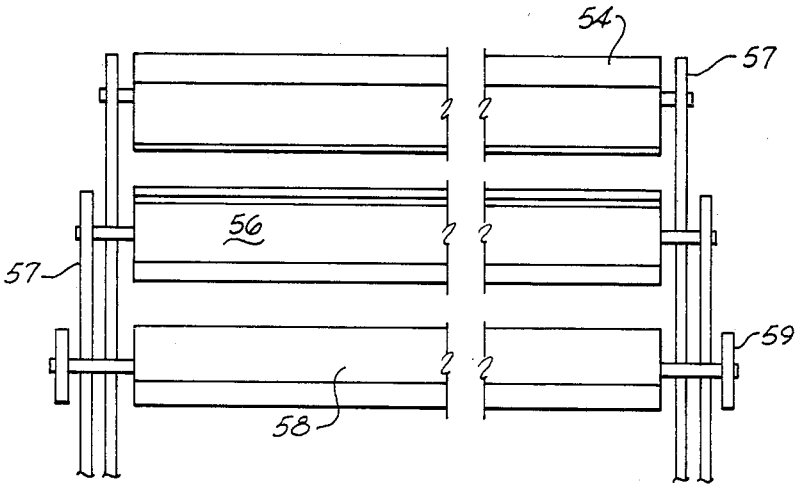
FIG. 15 is a diagrammatic elevation of the apparatus illustrated in FIG. 14 taken along lines 15—15 thereof.
Figure 14:
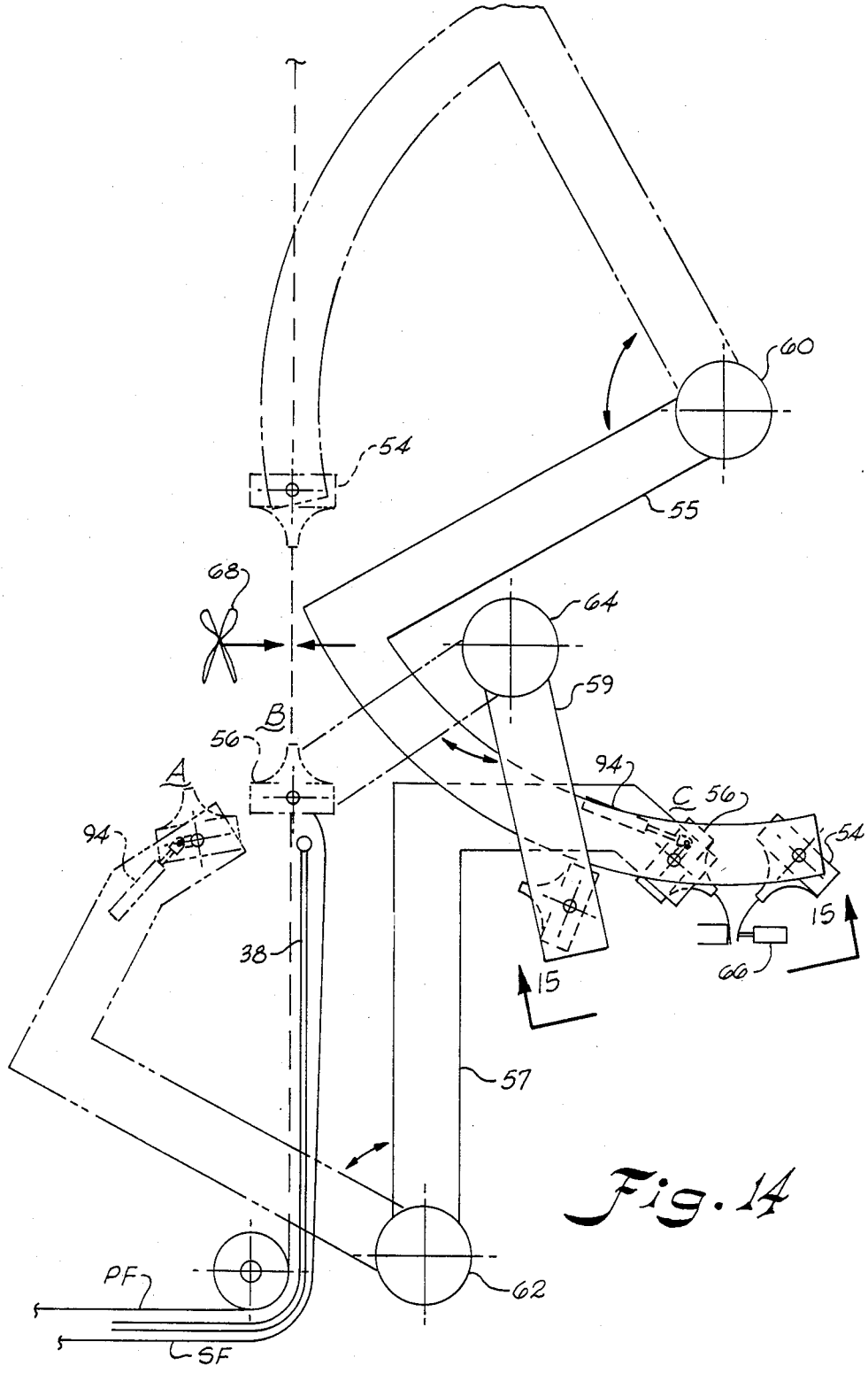
FIG. 14 is a schematic side elevational view of an automated apparatus according to the present invention.

Referring now to FIGS. 14 and 15 an automated device for carrying out the method of the invention without the need for human intervention is illustrated. A tail end clamp 54 is supported on a tail end clamp arm 55 which pivots about a torque tube support 60. Clamping means 54, in turn, is pivotally supported by arm 55 to permit it to move clockwise as it moves from the run position shown in dotted lines in FIG. 14, to the sewing position as shown in full lines in Figure 14.

At the same time, clamping means 56 for the head end of fabric PF is supported by a head end clamping arm 57 which is pivotally supported on torque tube support 62 for movement between three different positions. The first dotted line position A-to the left of FIG. 14 shows the clamping means 56 in its rest or holding position. The second dotted line position B along the fabric line shows the run position for either head end clamp 56 or secondary fabric head end clamp 58 in the running position. The full line position shows the head end clamp 56 for the primary fabric in the sewing position where clamping means 56 has been pivoted in a clockwise direction to properly present the head end of the primary fabric to a sewing station 66. With the trailing and head end of the two fabrics located in their respective clamps 54, 56 at station 66, the sewing machine is traversed across the width of the fabrics to sew the head end of the primary fabric to the tail end of the secondary fabric.

While this is taking place, the head end of the secondary fabric SF is held by clamping means 58 which is pivotally supported on arm 58 which, in turn, is supported for rotation about a torque tube 64, as seen in FIG. 14. In FIG. 14, the full line position of arm 59 shows the head end of the secondary fabric being held at rest in an out of the way position.

Whenever it is desired to transport the secondary fabric SF through the fabric processing instead of the primary fabric, clamping means 54 and 56 are closed automatically after the fabric movement is interrupted, to grip the primary fabric at spaced points, at which time the fabric is severed between the clamping points automatically by cutter 68. The head end of the primary fabric is then held by clamping means 56 which, in turn, is moved into the dotted line hold position A shown in FIG. 14 out of the way of the secondary fabric SF. At the same time, arm 55 is pivoted about torque tube support 60 to the full line position shown in FIG. 14 to present the tail end of the primary fabric to the sewing station 66. At this time, arm 59 is swung about its torque tube support 64 to bring the clamping means 58 into the sewing position at C as seen in FIG. 14. The head end of the secondary fabric SF and the tail end of the primary fabric PF are aligned at the sewing station 66 and the sewing machine is automatically operated to traverse the width of the fabrics to sew the ends of said fabric together, at the same time trimming any excess material from the seam.

After the ends of the fabric are sewn together, clamp 54 is moved back to its dotted line run position, as seen in FIG. 14, and clamp 58 is moved into the dotted line run position B as also seen in FIG. 14. Both clamps are then opened to permit free passage of the secondary fabric SF therethrough enroute to the fabric processing machine.

It is to be understood, that means for pivoting the support arms 55, 57 and 59 may take any well known configuration, such as gear segments, cranks or the like and that the pivoting of the clamping means on the respective support arms may readily be accomplished by those skilled in the art by use of cams, actuators, solenoids or the like so as to present the clamps in the positions necessary as desired carrying out the process. It will be further understood that the operation of the device shown in FIGS. 14 and 15 may be automated and controlled by a process control device, such as a computer or the like. Details of such controls are deemed to be within the scope of those skilled in the art and are not shown herein.

Figure 16:
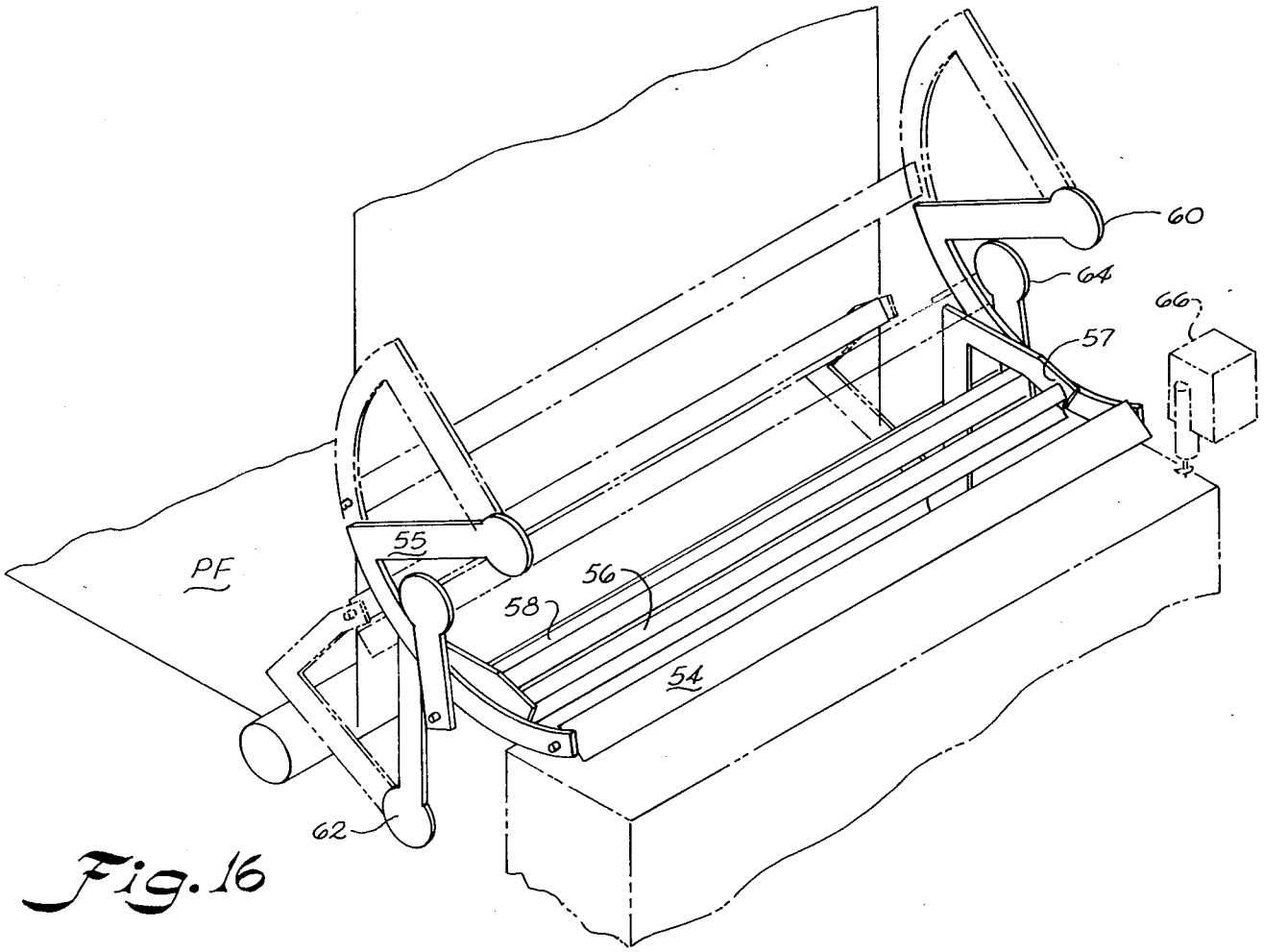
FIG. 16 is a perspective view of the apparatus illustrated in FIGS. 14 and 15 showing the relationship between the support arms for the fabric clamps.

An example of an actuator which may be used to index the clamping means on the support arms is shown in FIGS. 14 and 16 for arm 57 and clamping means 56. Like devices on arms 55 and 59 have been omitted for clarity. The actuator is illustrated as a pneumatic cylinder 94 which has its piston rod pivotally connected to clamping means 56 for pivoting the clamping means on the end of arm 57 between a sewing position, as seen in solid lines, and a run position B or holding position A, as seen in the dotted lines in FIG. 14. Cylinder 94 may be operated by movement of arm 57, by proximity switches at the various locations, by a program controller, limit switches or the like. Such actuators may be applied to each of the support arms for the clamping means as seen in FIG. 16.

Having described the present invention in detail, it is obvious that one skilled in the art will be able to make variations and modifications thereto without departing from the scope of the invention. Accordingly, the scope of the invention will be determined only by the scope of the claims appended hereto.

What is claimed is:

1. A fabric splicing system for a fabric processing machine, comprising:

(a) means for feeding a fabric to said fabric processing machine;

(b) a supply of a primary fabric engaged by said feeding means and transported thereby to said fabric processing machine;

(c) means for interrupting the feeding of said primary fabric to said fabric processing machine;

(d) a tail end clamping means, having clamping surfaces supported on opposite sides of said primary fabric for engaging and holding said fabric after the feeding is interrupted at a first point;

(e) a head end clamping means, having clamping surfaces supported on opposite sides of said primary fabric for engaging and holding said fabric, after the feeding is interrupted at a second point located between said first point and said primary fabric supply;

(f) means for severing said primary fabric at a point between said first and second points after the feeding is interrupted and the fabric is engaged by said tail end and head end clamping means, whereby a free end of said primary fabric extends beyond each of said clamping means;

(g) a supply of a secondary fabric;

(h) a head end secondary fabric clamping means, having clamping surfaces in clamping engagement on opposite sides of said secondary fabric, adjacent one end thereof and having a free end portion extending beyond said clamping means, said clamping means being supported adjacent to said primary fabric head end clamping means;

(i) a support means for supporting said tail end clamping means and said secondary fabric head end clamping means in alignment with each other, thereby aligning the free ends of said primary and secondary fabric on said support means;

(j) sewing means for sewing said aligned fabric ends together;

(k) supporting means for supporting said tail end clamping means and said secondary fabric head end clamping means in run positions where said secondary fabric may be guided from said secondary supply to said fabric processing machine;

(l) means for releasing said tail end clamping means and said secondary fabric head end clamping means to permit said secondary fabric to pass between said clamping surfaces; and (m) means for restarting said feeding means to transport said secondary fabric to said fabric processing machine.

2. A fabric splicing system as set forth in claim 1, wherein said sewing head is mounted on traverse rods for guiding it across the width of the fabrics.

3. A fabric splicing system as set forth in claim 1, wherein said severing means is supported on traverse rods for guiding the severing means across the width of said fabrics.

4. A fabric splicing system as set forth in claim 1, wherein separator means are provided for separating said primary fabric from said secondary fabric.

5. A fabric splicing system as set forth in claim 1, wherein at least one of said clamping means have clamping surfaces which comprise a brush on one side of the fabric and a pin surface on the other side of the fabric, said pins adapted to penetrate said fabric and to engage said brush on the opposite side thereof.

6. A fabric splicing system as set forth in claim 1, wherein said sewing means comprises a needle which operates in the horizontal plane to sew said fabric together.

7. A fabric splicing system as set forth in claim 1, wherein said sewing means comprises a needle which operates in the vertical plane to sew said fabrics together.

8. A fabric splicing system for a fabric processing machine, comprising:

(a) a supply of a primary fabric;

(b) means to feed said primary fabric to said fabric processing machine;

(c) stopping means for interrupting the feeding of said primary fabric to said fabric processing machine;

(d) tail end clamping means supported on a pair of swing arms for movement therewith, and pivotal movement thereon, having clamping surfaces disposed on opposite sides of said primary fabric for engaging and holding said fabric, after the feeding is interrupted, at a first point;

(e) primary fabric head end clamping means, supported on a pair of swing arms for movement therewith, and pivotal movement thereon, having clamping surfaces disposed on opposite sides of said primary fabric for engaging and holding said fabric, after the feeding is interrupted, at a second point located between said point and said fabric supply;

(f) means for severing said primary fabric at a point between said first and second points after the feeding of said fabric is interrupted, whereby a free end of said primary fabric extends beyond each of said clamping means;

(g) a supply of a secondary fabric;

(h) secondary fabric head end clamping means, supported on a pair of swing arms for movement therewith and pivotal movement thereon, having clamping surfaces in clamping engagement on opposite sides of said secondary fabric, having a free end of said secondary fabric extending beyond said clamping means;

(i) means for moving said tail end clamping means and said secondary fabric head end clamping means to a sewing station in close proximity to each other wherein the head and tail ends of fabric extending beyond said clamping surfaces are aligned at said sewing station;

(j) sewing means for sewing said aligned fabric ends together at said sewing station;

(k) means for moving said tail end clamping means and said secondary fabric head end clamping means to a run position and for opening both of said clamping means to permit said secondary fabric to be drawn therebetween; and (l) means for restarting said feeding means to transport said secondary fabric to said fabric processing machine.

9. A fabric splicing system as set forth in claim 8, wherein said sewing head is mounted on traverse rods for guiding it across the width of the fabrics.

10. A fabric splicing system as set forth in claim 8, wherein said severing means is supported on traverse rods for guiding the severing means across the width of said fabrics.

11. A fabric splicing system as set forth in claim 8, wherein separator means are provided for separating said primary fabric from said secondary fabric.

12. A fabric splicing system as set forth in claim 8, wherein said clamping means have clamping surfaces which comprises a brush on one side of the fabric and a pin surface on the other side of the fabric, said pins adapted to penetrate said fabric and to engage said brush on the opposite side thereof.

13. A fabric splicing system as set forth in claim 8, wherein said sewing means comprises a needle which operates in the horizontal plane to sew said fabric together.

14. A fabric splicing system as set forth in claim 8, wherein said sewing means comprises a needle which operates in the vertical plane to sew said fabrics together.

15. A web splicing system comprising:

(a) a web joining station located adjacent a path of web travel;

(b) first and second web clamping means spaced apart along said path of web travel, said clamping means being operative to permit web travel therethrough during normal operation and to clamp said web when web splicing is desired; said first clamping means being movable to and from said web joining station, and said second clamping means being movable to and from said web joining station;

(c) web severing means located adjacent said web path of travel between said first and second clamping means and being movable between an inactive position and a web severing position for severing said web when said web is clamped by said first and second clamp means;

(d) third web clamping means located adjacent said path of web travel for receipt of a secondary web and being movable between said web joining station and said path of web travel; and (e) means located at said web joining station for joining web ends held by two of said web clamping means located thereat.

16. A web splicing system as defined in claim 15 wherein said clamping means are each pivotally mounted on arm supports for movement therewith.

17. A web splicing system as defined in claim 16 wherein said clamping means further comprise means for proper orientation thereof at said web joining station and during normal operation.

18. A web splicing system as defined in claim 17 wherein said clamping means include pin means for engaging and holding said web when said clamping means are in a clamping position.

19. A fabric splicing system for a fabric processing machine comprising:

(a) a splicing station located adjacent said processing machine;

(b) fabric sewing means located at said splicing station and being movable transversely thereacross to sew said fabric; and (c) fabric clamping means located on opposite sides of a path of fabric travel to said processing machine, said clamping means being open during normal operation and closable when it is desired to splice said fabric, said clamping means being mounted for movement between said path of fabric travel and said splicing station for alignment with a second fabric for sewing thereto and for returning to said path of travel after said sewing has been completed.

20. A fabric splicing system as defined in claim 19 wherein said clamping means extend across the full width of the path of fabric travel and is mounted on a pair of pivotal arms, whereby when said clamping means are closed to clamp said fabric, said arms may be pivoted to move said fabric to said splicing station.

21. A web splicing system as defined in claim 20 wherein said clamping means is pivotally mounted on said arms whereby said clamping means may be pivoted at said splicing station to properly present said fabric clamped thereby to said sewing means.

* * * * *